US007886838B2

(12) United States Patent
Hahn

(10) Patent No.: US 7,886,838 B2
(45) Date of Patent: Feb. 15, 2011

(54) HAMMER

(75) Inventor: Norbert Hahn, Hünstetten-Limbach (DE)

(73) Assignee: Black & Decker Inc., Newark, DE (US)

( * ) Notice: Subject to any disclaimer, the term of this patent is extended or adjusted under 35 U.S.C. 154(b) by 141 days.

(21) Appl. No.: 12/405,424

(22) Filed: Mar. 17, 2009

(65) Prior Publication Data

US 2009/0236112 A1 Sep. 24, 2009

(30) Foreign Application Priority Data

Mar. 18, 2008 (GB) ..... 0804964.5

(51) Int. Cl.
*B25D 17/04* (2006.01)
*E02D 7/02* (2006.01)

(52) U.S. Cl. ..... 173/162.2; 173/162.1; 173/170; 173/210; 16/110.1

(58) Field of Classification Search ..... 173/162.2, 173/162.1, 170, 48, 201, 211; 16/110.1, 16/431, 443
See application file for complete search history.

(56) References Cited

U.S. PATENT DOCUMENTS

| | | | | |
|---|---|---|---|---|
| 3,637,029 | A * | 1/1972 | Sherwood et al. | 173/162.2 |
| 4,749,049 | A * | 6/1988 | Greppmair | 173/162.2 |
| 5,025,870 | A * | 6/1991 | Gantner | 173/162.2 |
| 5,697,456 | A * | 12/1997 | Radle et al. | 173/162.2 |
| 6,076,616 | A * | 6/2000 | Kramp et al. | 173/162.2 |
| 6,766,868 | B2 * | 7/2004 | Frauhammer et al. | 173/48 |
| 6,913,088 | B2 * | 7/2005 | Berger | 173/48 |
| 7,076,838 | B2 * | 7/2006 | Meixner | 16/431 |
| 7,287,601 | B2 * | 10/2007 | Hellbach et al. | 173/162.2 |
| 7,500,527 | B2 * | 3/2009 | Fischer et al. | 173/162.2 |
| 7,591,325 | B2 * | 9/2009 | Robieu | 173/162.2 |
| 7,610,967 | B2 * | 11/2009 | Fischer et al. | 173/162.2 |
| 7,637,328 | B2 * | 12/2009 | Sato | 173/162.2 |
| 2007/0144750 | A1 | 6/2007 | Buchenau et al. | |

FOREIGN PATENT DOCUMENTS

| | | |
|---|---|---|
| EP | 0033304 | 8/1981 |
| EP | 1870209 | 12/2007 |
| EP | 1882559 | 1/2008 |
| EP | 1908558 | 4/2008 |

(Continued)

*Primary Examiner*—Scott A. Smith
(74) *Attorney, Agent, or Firm*—Kofi Schulterbrandt; Scott B. Markow; Adan Ayala

(57) ABSTRACT

A hammer comprising: a body; a tool holder mounted on the body for holding a cutting tool; a handle, comprising a grip portion, pivotally mounted on the body about an axis of pivot; a first vibration dampener which connects between the handle and the body and which reduces the amount of angular vibrations transmitted from the body to the handle; a motor mounted within the body; a hammer mechanism mounted in the body, capable of being driven by the motor when the motor is activated, the hammer mechanism, when driven, imparting impacts onto a cutting tool when held by the tool holder; wherein at least the grip portion of the handle is also slideably mounted on the body so that the position of the grip portion can be linearly moved relative to the body; and there is further provided a second vibration dampener located between the grip portion and the body which reduces the amount of linear vibrations transmitted from the body to the grip portion.

15 Claims, 9 Drawing Sheets

FOREIGN PATENT DOCUMENTS

| | | |
|---|---|---|
| EP | 1958735 | 8/2008 |
| GB | 1549771 | 8/1979 |
| GB | 2160810 | 1/1986 |
| GB | 2402098 | 12/2004 |
| GB | 2431133 | 4/2007 |
| WO | 9523050 | 8/1995 |

* cited by examiner

HAMMER

CROSS-REFERENCE TO RELATED APPLICATIONS

This application claims priority, under 35 U.S.C. §119(a)-(d), to UK Patent Application No. GB 08 049 64.5 filed Mar. 18, 2008, the contents of which is incorporated herein by reference in its entirety.

FIELD OF THE INVENTION

The present invention relates to a hammer and in particular, to a handle for a hammer.

BACKGROUND OF THE INVENTION

One type of hammer, often referred to as a hammer drill, can have three modes of operation. Such a hammer typically comprises a spindle mounted for rotation within a housing which can be selectively driven by a rotary drive arrangement within the housing. The rotary drive arrangement is driven by a motor also located within the housing. The spindle rotatingly drives a tool holder of the hammer drill which in turn rotatingly drives a cutting tool, such as a drill bit, releaseably secured within it. Within the spindle is generally mounted a piston which can be reciprocatingly driven by a hammer drive mechanism which translates the rotary drive of the motor to a reciprocating drive of the piston. A ram, also slideably mounted within the spindle, forward of the piston, is reciprocatingly driven by the piston due to successive over and under pressures in an air cushion formed within the spindle between the piston and the ram. The ram repeatedly impacts a beat piece slideably located within the spindle forward of the ram, which in turn transfers the forward impacts from the ram to the cutting tool releasably secured, for limited reciprocation, within the tool holder at the front of the hammer drill. A mode change mechanism can selectively engage and disengage the rotary drive to the spindle and/or the reciprocating drive to the piston. The three modes of operation of such a hammer drill are; hammer only mode, where there is only the reciprocating drive to the piston; drill only mode, where there is only the rotary drive to the spindle, and; hammer and drill mode, where there is both the rotary drive to the spindle and reciprocating drive to the piston.

EP1157788 discloses such a hammer.

Another type of hammer only has a hammer only mode and which is more commonly referred to as a chipper. EP1640118 discloses such a chipper.

A third type of hammer will have hammer only mode and hammer and drill mode. GB2115337 discloses such a hammer. In GB2115337, the hammer mechanism comprises a set of ratchets which, when the drill is in hammer and drill mode, ride over each other to create vibrational movement which is superimposed on the rotary movement of the tool holder, thus imparting impacts onto a tool held by the tool holder.

However, all types of hammer will have a hammer mechanism which, when activated, will impart impacts to a cutting tool when held in the tool holder.

BRIEF SUMMARY OF THE INVENTION

Accordingly there is provided a hammer comprising:

a body;

a tool holder mounted on the body for holding a cutting tool;

a handle, comprising a grip portion, pivotally mounted on the body about an axis of pivot;

a first vibration dampener which connects between the handle and the body and which reduces the amount of angular vibration transmitted from the body to the handle;

a motor mounted within the body;

a hammer mechanism mounted in the body, capable of being driven by the motor when the motor is activated, the hammer mechanism, when driven, imparting impacts onto a cutting tool when held by the tool holder;

wherein at least the grip portion of the handle is also slideably mounted on the body so that the position of the grip portion can be linearly moved relative to the body; and there is further provided a second vibration dampener located between the grip portion and the body which reduces the amount of linear vibrations transmitted from the body to the grip portion.

BRIEF DESCRIPTION OF THE DRAWINGS

Three embodiments of the present invention will now be described with reference to the accompanying drawings of which.

DETAILED DESCRIPTION OF THE INVENTION

Figure 1:
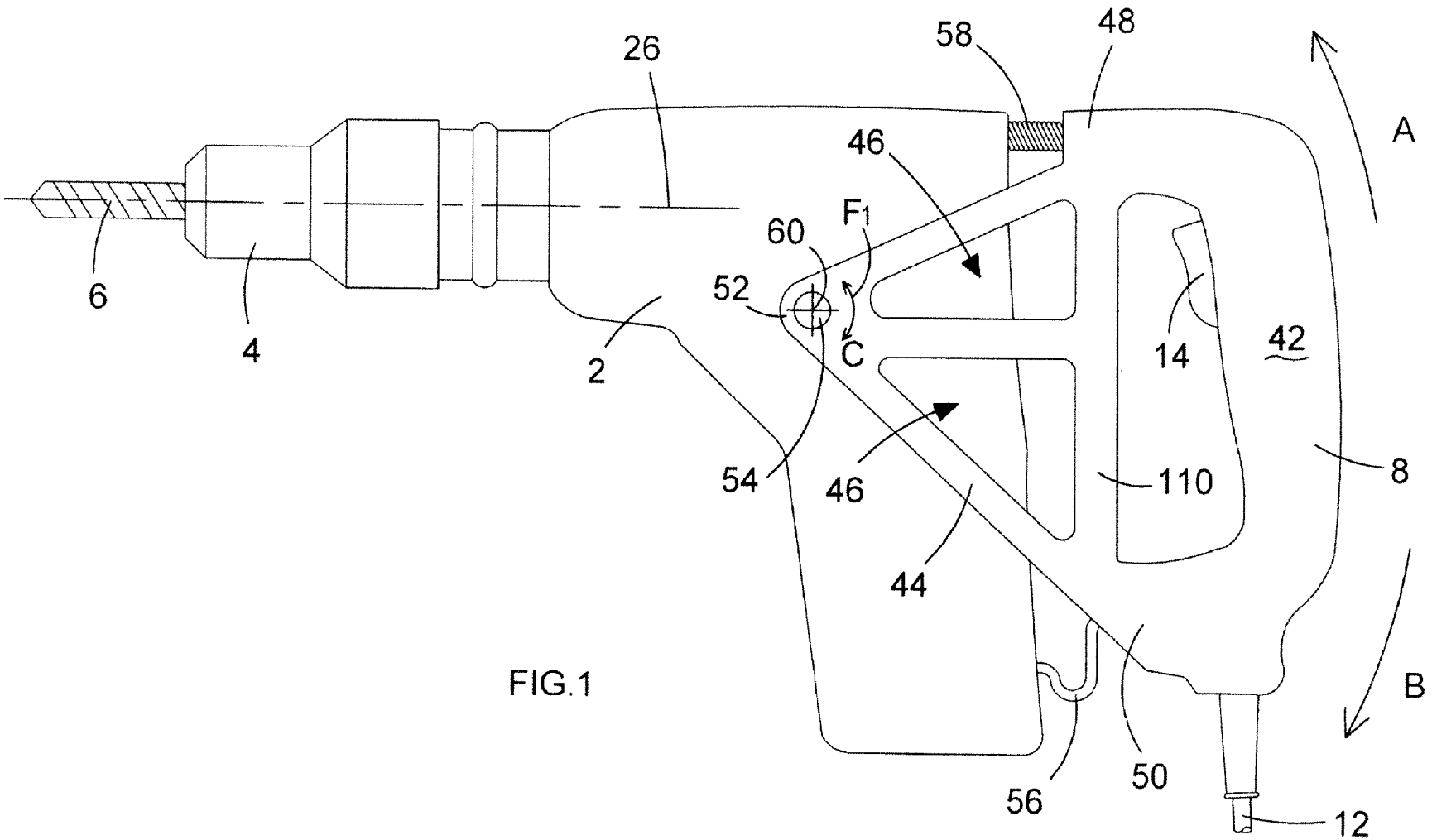
FIG. 1 shows a side view of a hammer.
Figure 2A:
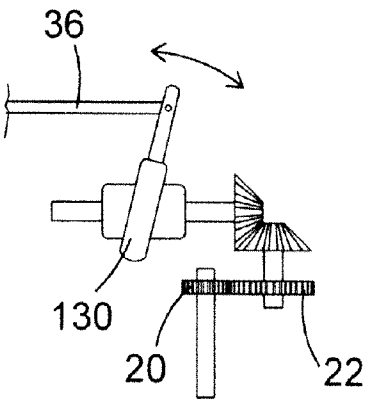
FIG. 2A shows a schematic diagram of part on an alternative hammer mechanism to that shown in FIG. 2.
Figure 2:
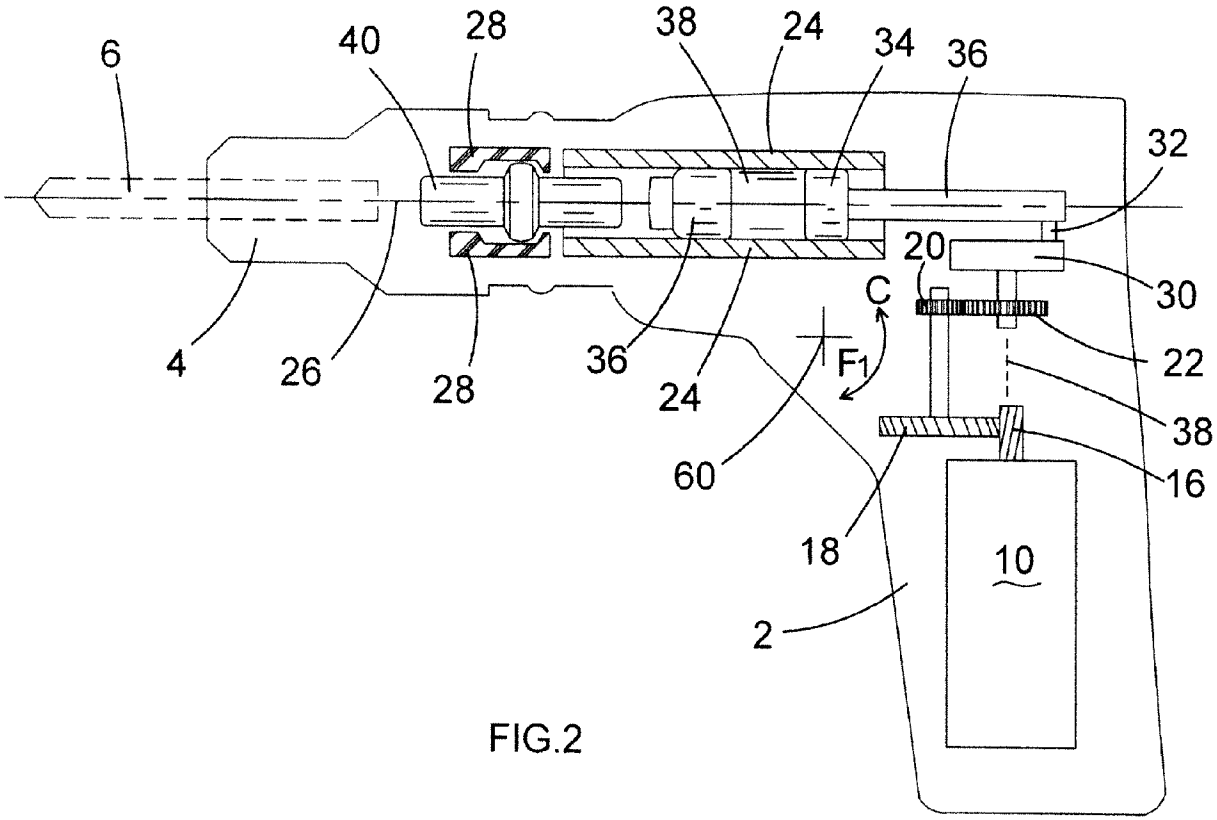
FIG. 2 shows a schematic diagram of the hammer mechanism of the hammer shown in FIG. 1.
Figure 3:
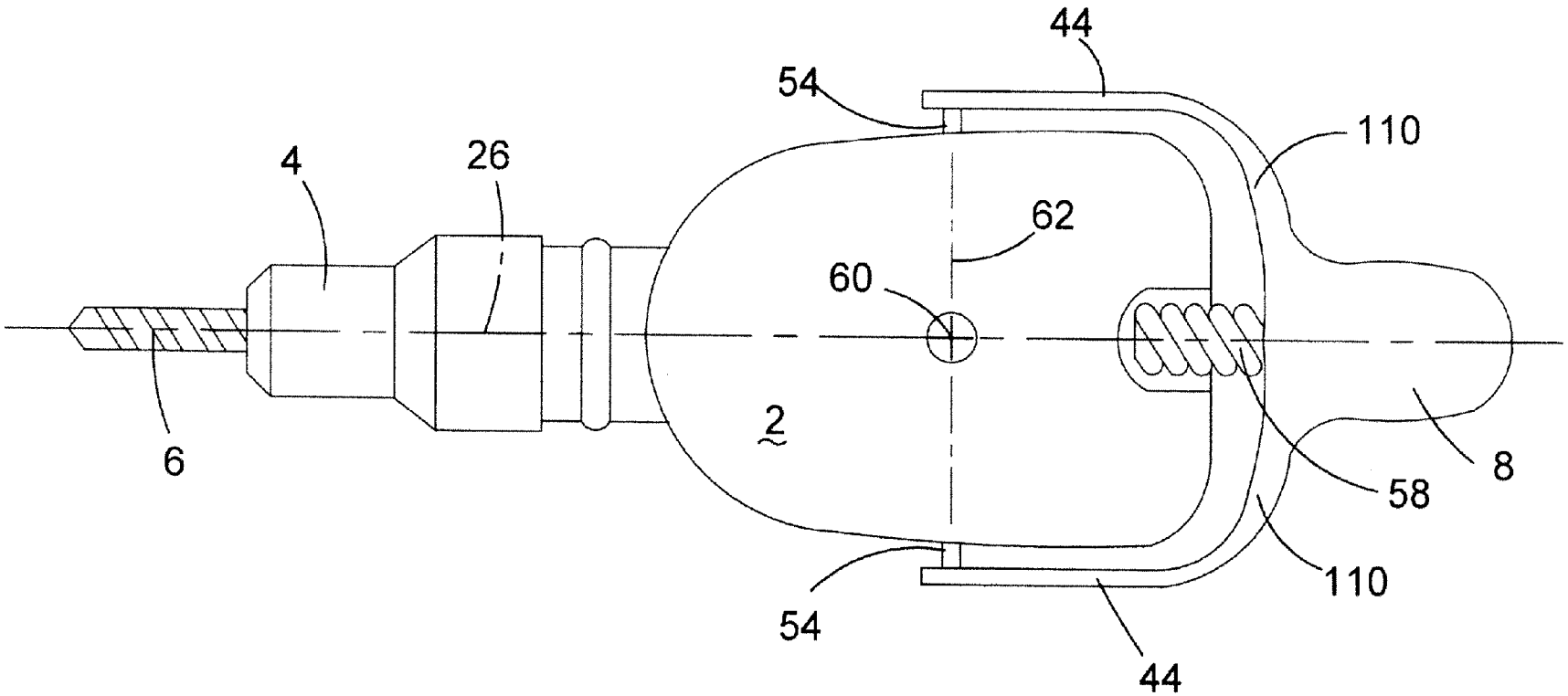
FIG. 3 shows a top view of the hammer shown FIG. 1.

Referring to FIGS. 1, 2 and 3 which show a design of hammer having a pivotal handle 8, the hammer comprises a body 2. Mounted on the front of the body 2 is a tool holder 4 which is capable of holding a cutting tool 6, such as a drill bit. Pivotally mounted on the body 2 is the handle 8 by which a user can support the hammer.

Mounted inside the body 2 is an electric motor 10 (see FIG. 2) which is powered via a mains electric cable 12 via a trigger switch 14. Depression of the trigger switch 14 activates the motor 10.

The drive spindle 16 of the motor 10 drives a hammer mechanism (which is described in more detail below) via a number of gears 18, 20, 22. A cylinder 24 of circular cross section is mounted within the body 2. The longitudinal axis 26 of the cylinder 24 is coaxial with the longitudinal axis of a cutting tool 6 when held in the tool holder 4. A beat piece support structure 28 is mounted within the body 2 between the cylinder 24 and the tool holder 4.

As shown in FIG. 2, the hammer mechanism includes a crank mechanism which comprises a drive wheel 30 mounted eccentrically on which is a pin 32. A piston 34 is slidingly mounted within the cylinder 24. A rod 36 connects between the rear of the piston and the pin 32. Rotation of the wheel 30 by the motor 10 via the gears, 18, 20, 22, about its axis 38 results in rotation of the eccentric pin 32 around the axis of rotation 38 of the wheel 30. This results in an oscillating movement of the piston 34 in the cylinder. An alternative design of hammer mechanism uses a wobble bearing 130 in stead of a crank as shown in FIG. 2A.

The oscillating piston results in a reciprocating movement of the ram 36 within the cylinder due to the oscillating movement being transferred from the piston 34 to the ram 36 via an air spring 38. The ram repeatedly strikes a beat piece 40, slideably mounted within the beat piece support structure 28, which in turn repeatedly strikes the end of a cutting tool 6 when held in the tool holder 4. The axis along which the impact force is transferred to the end of the cutting tool is referred to as the drive axis. This is coaxial with the longitudinal axis 26 of the cylinder 24.

The rear handle 8 comprises a grip portion 42 by which an operator grasps the handle 8 to support the hammer. The top 48 and bottom 50 of the grip portion 42 are attached via a central interconnecting section 110 to two identical triangular side panels 44, which extend forward from the grip portion 42, parallel to each other. Triangular holes 46 are formed through the side panels 44. The tip 52 of each side panel 44 comprises a circular hole. A peg 54 is rigidly attached to the external wall of the body 2 on each side of the body 2, the two pegs 54 being symmetrical. One peg 54 locates within the hole in the tip 54 of each panel 44. The panels are slightly resilient, enabling them to be bent away from each other. This allows the tips 54, during assembly of the hammer, of the two panels 44 to be bent away from each other, in order to pass over the two pegs 54 until the two holes in the tips 52 are aligned with the pegs 54, and then released to allow the tips to move towards each other due to their resilient nature, allowing the pegs 54 to enter the holes and be retained within them. The panels 44, and hence the handle 8 can freely pivot about the pegs 54.

The mains cable 12 enters the lower end of the grip portion 42 of the handle 8 and passes internally until it connects to the trigger switch 14. A second cable 56 then passes internally within the handle 8 until it reaches the lower end where it externally links across to the body 2 of the hammer and then internally within the body until it contacts the motor 10.

A spring 58 connects between the top 48 of the grip portion 42 and the rear of the body 2. The spring 58 biases the handle 8 to a predetermined position where the grip portion 42 is substantially vertical. The spring 58 can either be compressed or expanded, thus allowing the handle to pivot. Movement of the handle in the direction of Arrow A causes the spring 58 to compress, movement of the handle in the direction Arrow B causes the spring to expand. The handle can be pivoted away from its predetermined position against the biasing force of the spring 58. However, when released, the handle would return to its predetermined position.

The hammer has a centre of gravity 60. The construction and arrangement of the various components of the hammer results in the hammer having the centre of gravity 60 which is below (as seen in FIG. 1) the drive axis 26.

During use, the motor reciprocatingly drives the piston 34 which in turn reciprocatingly drives the ram 36 which in turn strikes the end of a cutting tool via the beat piece 40. The sliding movement of the piston 34, ram 36 and beat piece 40 is generally along the drive axis. The movement of the piston 34, ram 36 and beat piece 40, together with impact of ram against the beat piece, and the beat piece against the end of the tool bit 6 generate significant vibrations along the drive axis. Thus, the dominant vibrations of the hammer are in the direction of and aligned with the drive axis, which urge the body 2 to move in reciprocating manner along the drive axis 26. As the centre of gravity 60 of the hammer is below the drive axis 26, this reciprocating movement results in a rotational force F1 to be experienced in the body of the hammer about the centre of gravity 60, which in turn results in an angular reciprocating movement of the body 2 about the centre of gravity, as indicated by Arrow C, due to the vibrations.

The axis of pivot 62 of the handle 8 passes through the centre of gravity 60. Furthermore, the axis of pivot 62 extends in a plane which is perpendicular to the drive axis 26 so that the vibrational forces along the drive axis 26 are tangential to the axis of pivot 62. By mounting the handle 8 about an axis of pivot 62 which passes through the centre of gravity, the handle is able to be damped against the rotational forces (F1; Arrow C) in an optimum manner as the rotational movement of the body 2 due to the rotational forces of the vibrations (F1; Arrow C) and the pivotal movement of the handle are about the same axis. The spring 58 damps the rotary vibration (due rotational the force F1; Arrow C) about the centre of gravity and thus reduces the amount of vibration which is transferred to the handle 8 from the body 2.

Figure 4:
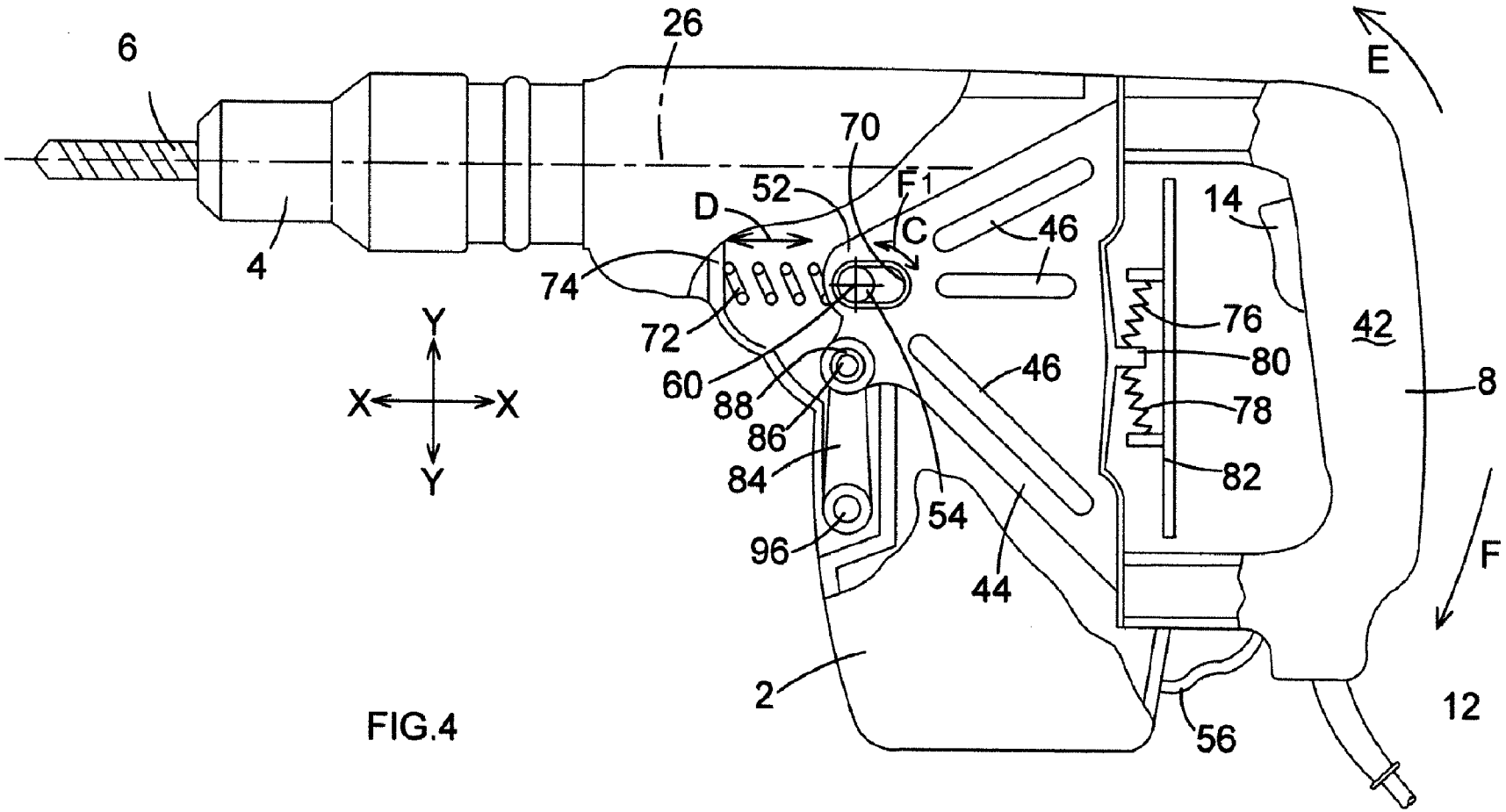
FIG. 4 shows a side view of a hammer which is an embodiment of the present invention.

FIG. 4 shows an embodiment of the present invention. Where the same features are present in the embodiment were present in the design of the hammer described previously with reference to FIGS. 1 to 3, the same reference numbers have been used. The majority of the features present in the design of the hammer described previously with reference to FIGS. 1 to 3 are present in the second embodiment. The difference (described in more detail below) is that the handle 8 is slideably mounted on the pegs 54 to allow for damping in a direction generally parallel to the drive axis 26 in addition to damping against rotational vibrational movement about the centre of gravity 60.

In the embodiment of the present invention, each panel 44 comprises an elongate hole 70 in which the corresponding peg 54 is located. This allows each peg 54 to slide in the X direction along the length of the hole 70. However, the width of the elongate hole is marginally larger that the diameter of the pegs so that a sliding movement of the pegs within the elongate holes in a Y direction is prevented.

On each side of the body 2, a front helical spring 72 (only one helical spring 72 and panel 44 are shown) is connected between an inner wall 74 of the body 2 and the tip 52 of a side panel 44. Each helical spring 72 biases the tip 52 of its respective panel 44 rearwardly so that the peg 54 is located in its foremost position within the elongate hole 70. The front springs 72 provide a biasing force between the body 2 and the handle 8, urging them away from each other. When an operator grasps the grip portion 42 of the handle 8 and applies a pressure to the hammer during normal use, the handle 8 moves forward against the biasing force of the front springs 72, the pegs 54 sliding rearwardly within the elongate holes 70. The elongate holes 70 allow for relative movement between the body 2 of the hammer and the rear handle 8 in the X direction (indicated by Arrow D). The springs 72 absorbs vibrations generated in the body 2 in the X direction, reducing the amount transferred from the body 2 to the handle 8 in the X direction.

The panels 44 of the handle 8 can still freely rotate about the pegs 54, and hence about an axis 62 which passes through the centre of gravity 60. Each panel 44 has a centre stump 80 located at the rear of the panel 44. Each centre stump 80 is connected via two rear helical springs 76, 78 to a rear wall 82 of the body (only one of the centre stumps 80 and its corresponding pair of springs 76, 78 are shown). As the handle 8 rotates about the pegs 54 in direction of Arrow E, the top spring 76 compresses and the bottom spring 78 expands, thus providing a resilient force against the pivotal movement of the handle 8. As the handle 8 rotates about the pegs 54 in direction of Arrow F, the top spring 76 expands and the bottom spring 78 compresses, thus providing a resilient force against the pivotal movement of the handle 8. The springs 76, 78 damp the rotary vibration (due rotational the force F1; Arrow C) which is transferred to the handle 8 from the body 2. The springs 76, 78 are arranged so that when no rotary force is applied to the handle 8, the handle 8 is held in a position where the grip 42 is roughly vertical.

If the handle is moved in the X direction, against the biasing force of the front springs 72, both of the rear springs 76, 78 are expanded to allow for the sliding movement of the handle 8 on the pegs 54. However, both springs 76, 78 continue to provide a biasing force against any pivotal movement of the handle 8 even when they have been expanded slightly by the sliding movement of the handle 8 on the body 2. As such, the rear springs 76, 78 provide a biasing force against pivotal movement of the handle 8 regardless of the position of the handle 8 on the body 2 (or pegs 54 within the elongate holes 70) and therefore provide rotational vibrational damping when the pegs 54 are at any position within the elongate holes 70.

As the handle 8 slides forward and backwards, the rear springs 76, 78 will expand and contract, providing some damping in the X direction. However, as the amount of expansion of the rear springs 76, 78 due to the sliding movement of the pegs within the elongate holes 70 is relatively small, the amount of damping caused by the springs 76, 78 in the X direction will be relatively small. As such, the amount of damping in the X direction will be dominated by the front springs 72.

Similarly, as the handle 8 pivots around the pegs 54, the forward springs 72 will expand and contract providing some damping against the pivotal movement. However, the amount of expansion of the forward springs 72 due to the pivotal movement of handle 8 about the pegs 54 is small and therefore, the amount of damping caused by the front springs 72 in a pivotal direction will be relatively small. As such, the amount of damping of the pivotal movement of the handle 8 will be dominated by the rear springs 76, 78.

Pivotally connected via a pivot mechanism to the lower side of the tip 52 of each panel 44, is the top of a vertical lever 84, there being one lever 84 located on each side of the body 2 of the hammer and which is associated with a corresponding panel 44. The pivot mechanism for each lever 84 comprises a horizontal axle 86 rigidly attached to the lever 84 and which projects perpendicularly relative to the longitudinal axis of the vertical lever 84 into a hole 88 formed through the lower side of the tip 54 of the panel. The lower end of each lever 84 is rigidly connected to an end of a bar 96, one lever being connected to one end of the bar 96, the other lever being connected to the other end. The bar 96 traverses the width of the body 2 and is pivotally mounted about its longitudinal axis on the body 2. Thus pivotal movement of one lever 84 about the longitudinal axis of the bar 96 results in a corresponding pivotal movement of the other lever. The levers 84 project in a direction from the ends of the bar 96 which is parallel to each other. The purpose of the two levers and bar is to ensure that the two panels 44 move in a forward or rearward direction in unison and that there is no twisting movement about a vertical axis which would be created if the panels 44 could move forwardly or rearwardly independently of the other panel.

The size of the holes 88 in the lower side of the tips 52 of the panels 44 is slightly larger than the diameter of the axles 86 within them to accommodate the pivotal movement of the levers whilst the panels slide linearly on the pegs.

It should be noted that the holes 46 in the panels 44 of the embodiment are elongate but serve no additional function that of the triangular holes 46 in the design of the hammer described previously with reference to FIGS. 1 to 3.

Figure 5:
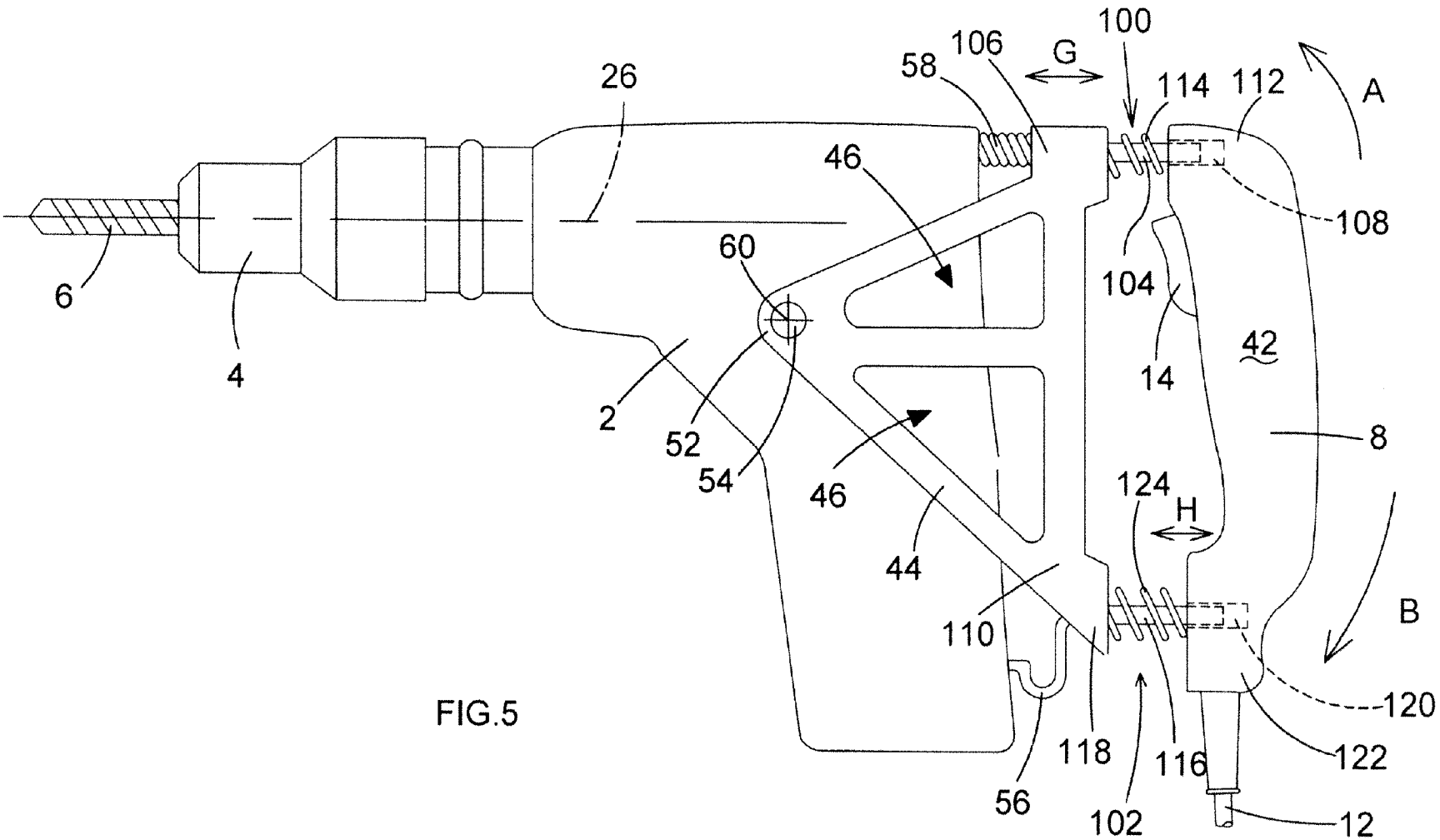
FIG. 5 shows a side view of a hammer according to the second embodiment of the present invention.
Figure 6:
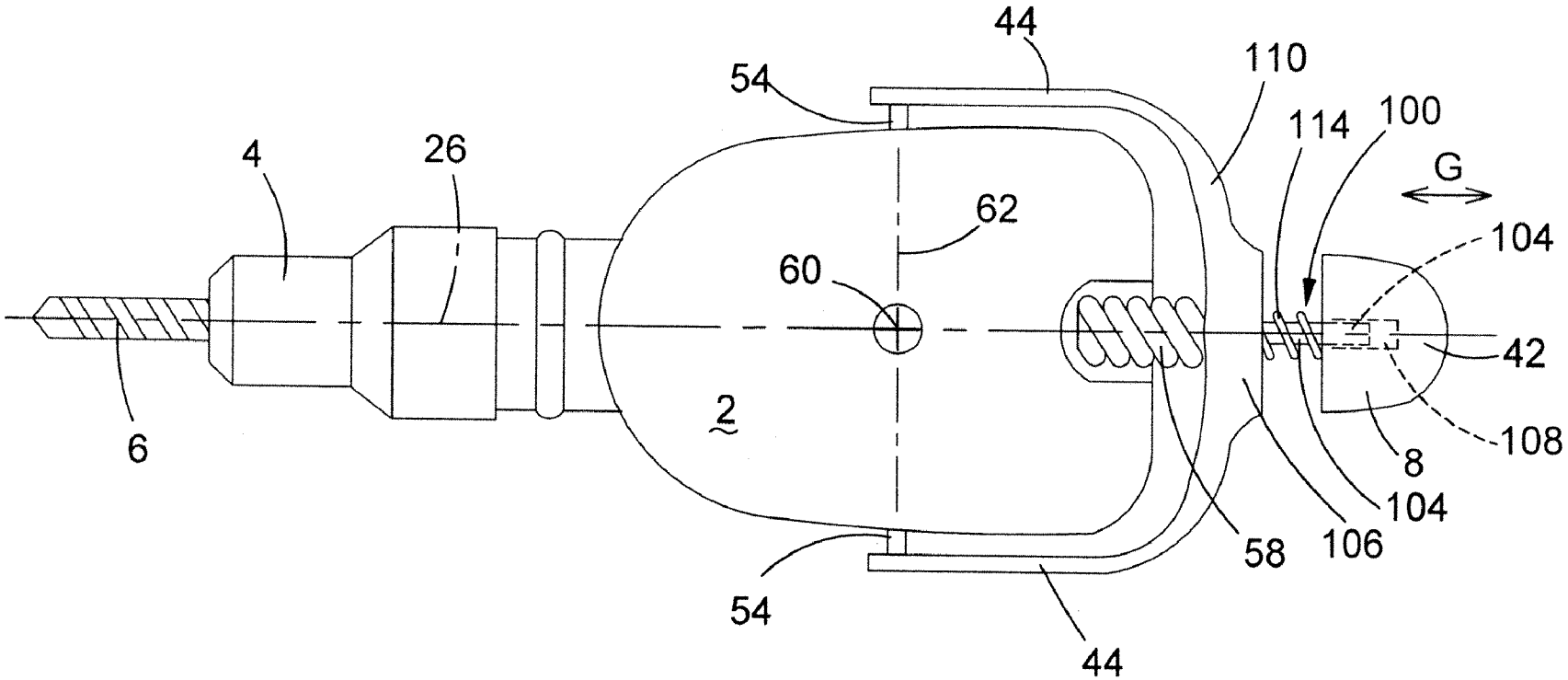
FIG. 6 shows a top view of the hammer shown FIG. 5.

FIGS. 5 and 6 shows a second embodiment of the present invention. Where the same features are present in the second embodiment which were present in the design of the hammer described previously with reference to FIGS. 1 to 3, the same reference numbers have been used. The majority of the features present in the design of the hammer described previously with reference to FIGS. 1 to 3 are present in the second embodiment. The difference (described in more detail below) between the second embodiment and the described previously with reference to FIGS. 1 to 3 is that the grip portion 42 is attached to the panels 44 via two vibration dampening mechanisms 100, 102 which reduce the linear vibrations transferred to the grip portion 42 and allow the grip portion to slide linearly relative to the panels 44.

The top vibration dampening mechanism 100 comprises a rod 104 which projects from a top portion 106 of the central interconnecting section 110, which interconnects the two panels 44, into a tubular recess 108 formed in the top section 112 of the grip portion 42 of the handle 8. A spring 114 is sandwiched between the top portion 106 and the top section 112, which biases the grip 42 away from the panels. The rod 104 can slide in the direction of Arrow G, in and out of the recess 108. The rod 104 and the recess 108 are designed so that the top portion 106 can only slide linearly towards or away from the top section 112 of the grip portion 42, preventing any relative pivotal movement between the two. The spring 114 limits the amount of travel of the rod in and out of the recess 108. The spring 114 damps the vibrations in the direction of Arrow G, and thus reduces the amount of linear vibration transferred from the central interconnection section 110 to the top of the grip portion 42 of the handle.

The bottom vibration dampening mechanism 102 also comprises a rod 116 which projects from a bottom portion 118 of the central interconnecting section 110, which interconnects the panels 44, into a tubular recess 120 formed in the bottom section 122 of the grip portion 42 of the handle 8. A spring 124 is sandwiched between the bottom portion 118 and the bottom section 122, which biases the grip away from the panels. The rod 116 and the recess 120 are designed so that the bottom portion 118 can only slide linearly towards or away from the bottom section 122 of the grip portion 42, preventing any relative pivotal movement between the two. The rod 116 can slide in the direction of Arrow H, in and out of the recess 120. The spring 124 limits the amount of travel of the rod 116 in and out of the recess 120. The spring 124 damps the vibrations in the direction of Arrow H (parallel to Arrow G), and thus reduces the amount of linear vibration transferred from the central interconnection section 110 to the bottom of the grip portion 42 of the handle.

The two vibration dampening mechanisms 100, 102 only allow a linear sliding movement between the grip 42 and the interconnecting section 110. The two vibration dampening mechanisms 100, 102 provide linear vibration dampening to the grip portion 44 of the handle in a generally horizontal direction (parallel Arrows G and H) whilst the spring 58 provides rotational vibrational dampening of the handle 8.

FIGS. 7 to 10 show a third embodiment of the present invention.

Figure 7:
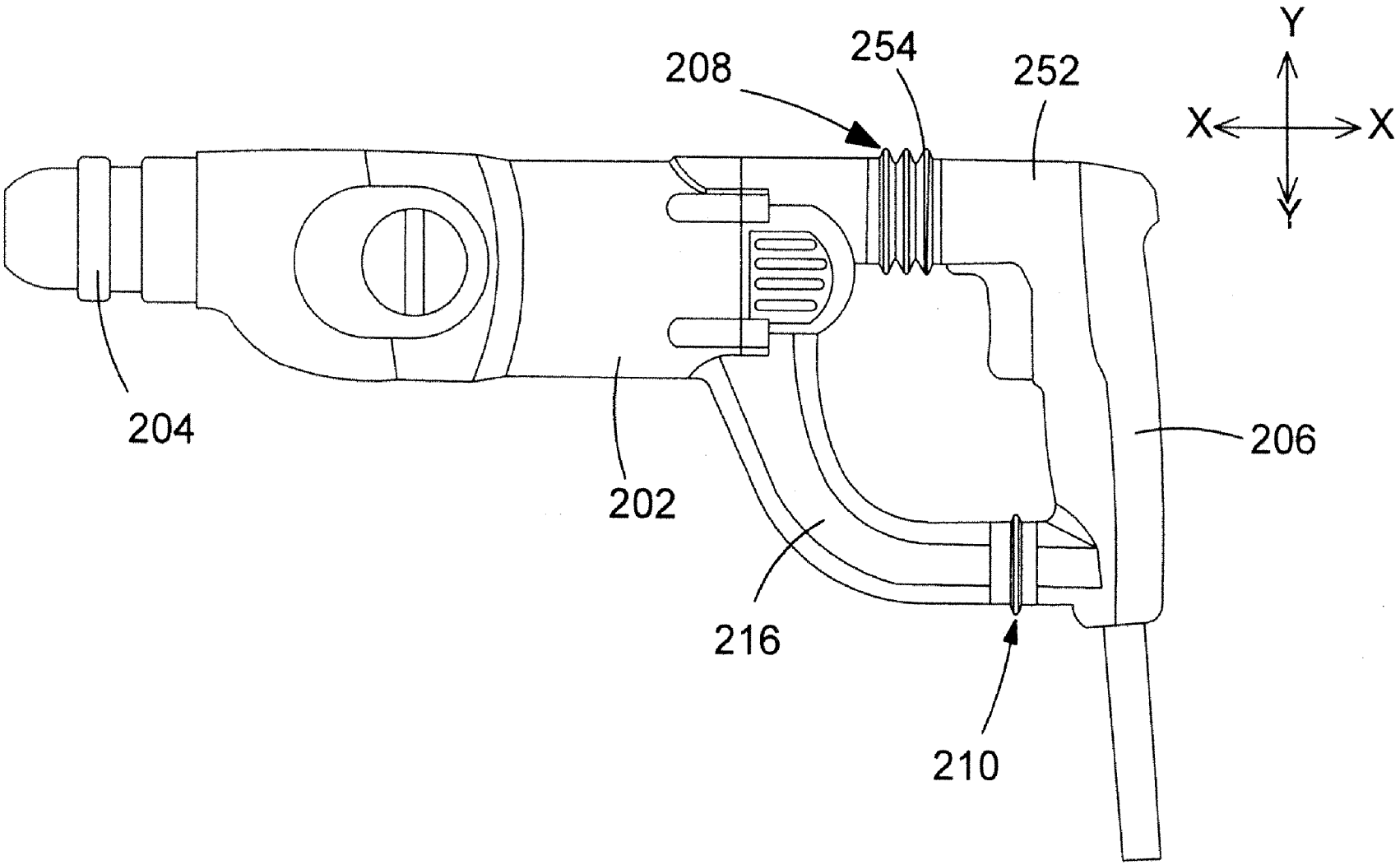
FIG. 7 shows a side view of a hammer according to the third embodiment of the present invention.

Referring to FIG. 7, the compact hammer comprises a body 202 having a tool holder 204 located at one end. Attached to the opposite end is a rear D shaped handle 206 connected via an upper joint 208 and a lower joint 10. The upper and lower joints comprise vibration damping elements to reduce the amount of vibration transferred from the body 202 to the rear handle 206.

The lower joint 210 connects to the body 202 via a curve rigid support arm 16 integrally formed with the body 2.

Figure 8:
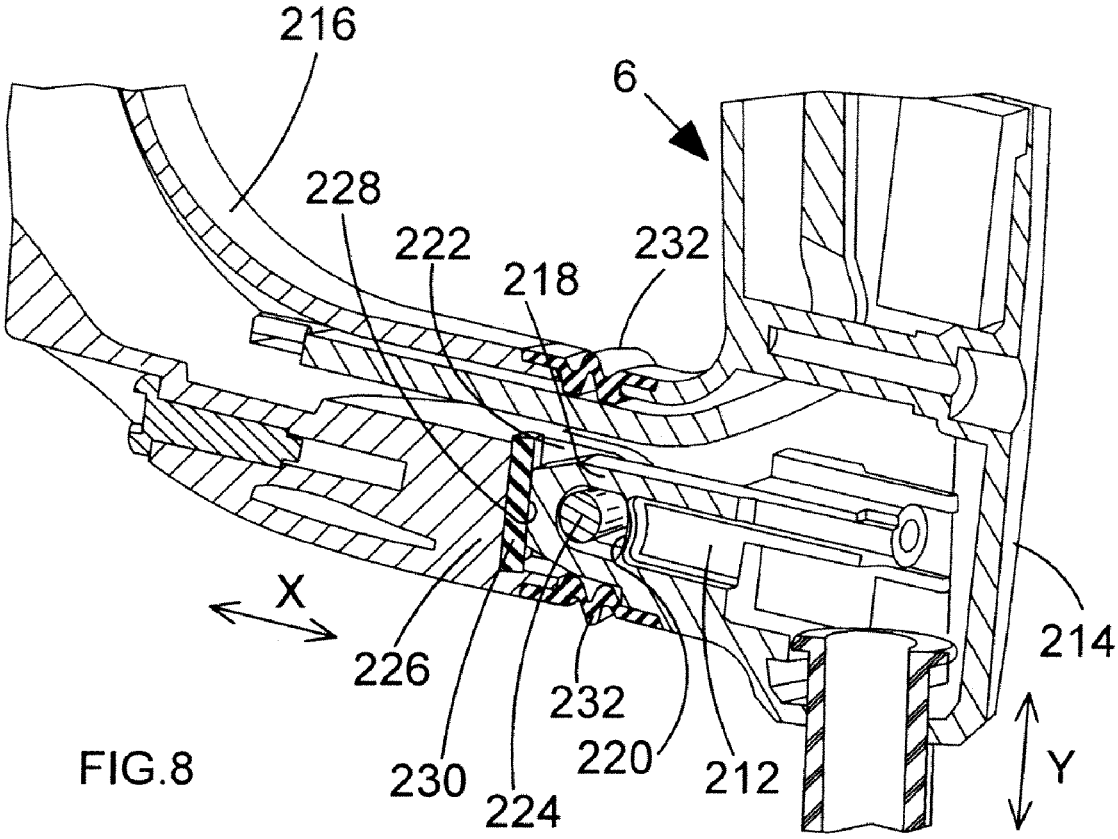
FIG. 8 shows vertical cross sectional view of the lower joint of the rear handle shown in FIG. 7.
Figure 8A:
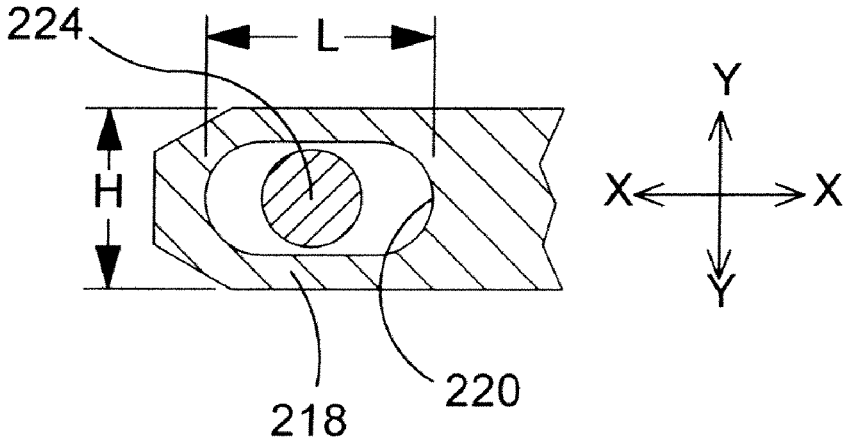
FIG. 8A being a close up view of the joint.
Figure 9:
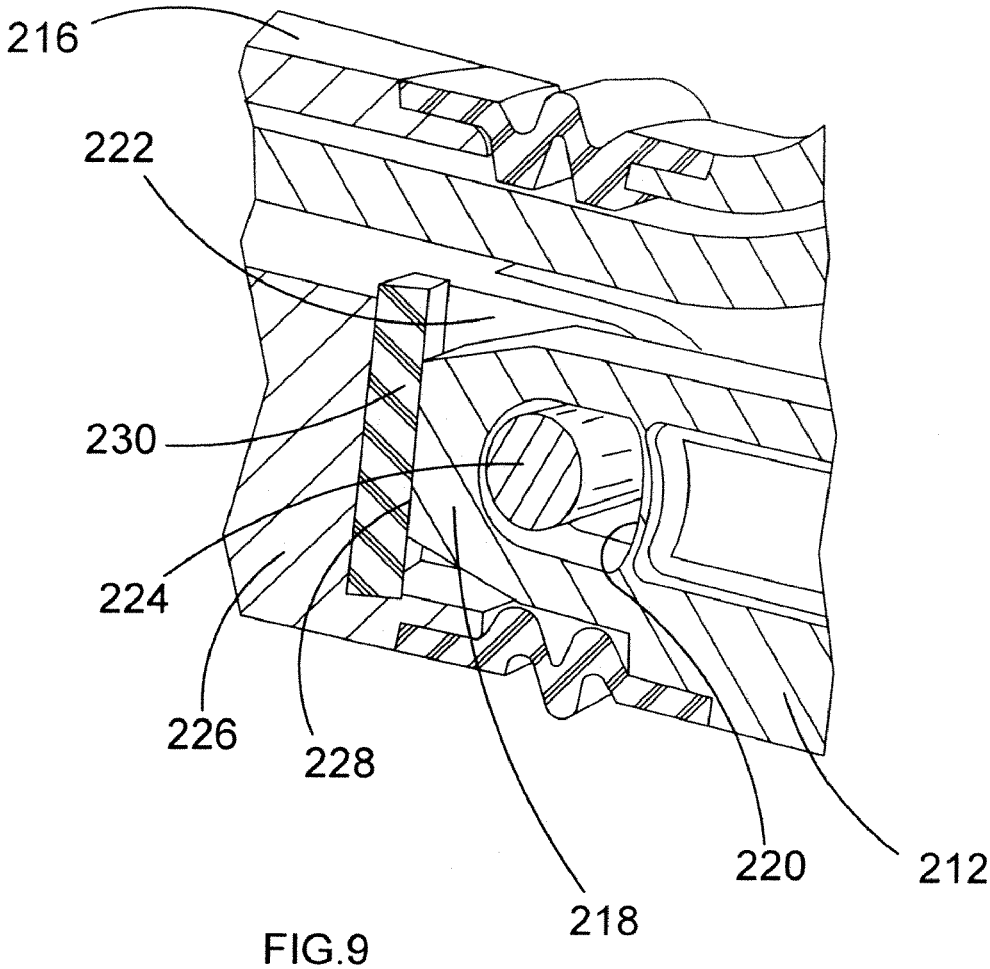
FIG. 9 shows a close up cross sectional view of the lower joint of the rear handle.

Referring to FIG. 8, the rear handle is constructed from forward 212 and rearward 214 clam shells which are screwed together. Formed on the lower end of the forward clam shall is a protrusion 218 formed through which is an oval hole 220. FIG. 8A shows a sketch of the hole 220. The end 228 of the protrusion 218 is flat.

The support arm 216 terminates in two parallel pivot supports 222 which project rearwardly from a base 226 (only one shown). A circular rod 224 is mounted between the two pivot supports 222. The two pivot support 222 are located on each side of the protrusion 218. The rod 224 passes through the oval hole 220. The height H of the hole 220 is 7.2 mm whereas the diameter of the rod 224 is 7 mm, leaving a 0.2 mm gap. This allows very limited free movement of the rod 224, and hence the lower part of the handle 206, in the Y direction. The length L of the hole 220 is substantially greater than the diameter of the rod 224, allowing free movement of the rod 224, and hence the lower part of the handle 206, in the X direction, to the extent the rod 224 can travel in the oval hole 220.

Sandwiched between the flat end 228 of the protrusion 218 and the base 226 is a resilient rubber pad 230 which biases the protrusion 218 rearwardly, moving the rod 224 to the forward end (left) of the oval hole 220. When the operator uses the drill, he applies a pressure to the rear handle, pushing the protrusion 218 towards the arm 216 against the biasing force of the rubber pad 230. The pad 230 compresses, allowing the rod 224 to move rearwardly (right) in the oval hole 220. This results in the vibrations in the X direction having to pass from the arm 216 to the protrusion 218 via the pad 230. As such, the vibrations in the X direction are damped. However, vibrations in the Y direction are not.

Bellows 232 surround the protrusion 218 and the pivot supports 222.

Figure 10:
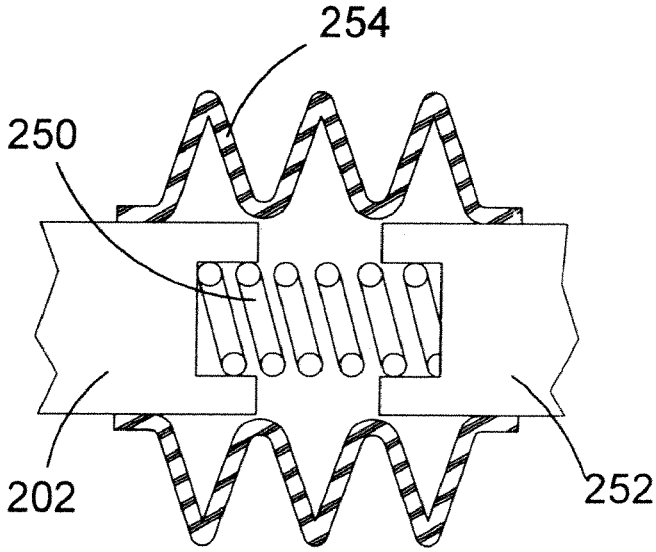
FIG. 10 shows a sketch of a vertical cross sectional view of the upper joint of the rear handle shown in FIG. 7.

FIG. 10 shows the upper joint 208 of the rear handle. The upper joint 208 comprises a helical spring 250 which connects between the body 202 and top section 252 of the handle and acts as a vibration dampener, dampening the angular movement of the rear handle about the rod 224. Bellows 254 surround the helical spring 250. The helical spring holds the top section 252 at a predetermined position relative to the body 202 when no pressure is exacted on the rear handle by an operator.

The invention claimed is:

1. A hammer comprising:

a body;

a tool holder mounted on the body for holding a cutting tool;

a handle, comprising a grip portion, pivotally mounted on the body about an axis of pivot;

a first vibration dampener which connects between the handle and the body and which reduces an amount of angular vibrations transmitted from the body to the handle;

a motor mounted within the body;

a hammer mechanism mounted in the body, capable of being driven by the motor when the motor is activated, the hammer mechanism, when driven, imparting impacts onto a cutting tool when held by the tool holder;

wherein at least the grip portion of the handle is also slideably mounted on the body so that the position of the grip portion can be linearly moved relative to the body; and there is further provided a second vibration dampener located between the grip portion and the body which reduces the amount of linear vibrations transmitted from the body to the grip portion.

2. A hammer as claimed in claim 1, wherein the first vibration dampener comprises biasing means which connects between the handle and the body and which biases the handle towards a predetermined angular position.

3. A hammer as claimed in claim 1, wherein at least the grip portion of the handle can slide linearly over a range of positions, the handle being able to freely pivot when the grip portion of the handle is located in any one of those positions.

4. A hammer as claimed in claim 3, wherein the whole of the handle is slideably mounted on the body so that the position of the handle can be linearly moved relative to the body, and the second vibration dampener is located between the handle and the body which reduces the amount of linear vibrations transmitted from the body to the handle.

5. A hammer as claimed in claim 4, wherein the second vibration dampener comprises biasing means which urges a sliding movement of the handle towards a predetermined position relative to the body.

6. A hammer as claimed in claim 1, wherein the handle is mounted on the body via a guide mechanism which enables the handle to pivot and slide on the body, wherein the guide mechanism comprises a first part mounted on the body and a second part mounted on the handle, one part comprising at least one peg which is rotatably and slideably mounted within an elongate aperture formed in the other part.

7. A hammer as claimed in claim 1, wherein the handle comprises at least two component parts, a first base section pivotally mounted to the body, and a second grip portion slideably mounted on the base section so that it is capable of being linearly moved relative to the base section, wherein the second vibration dampener is located between the base section and the grip portion and which reduces the amount of linear vibration transferred from the base section to the grip portion.

8. A hammer as claimed in claim 7, wherein the second vibration dampener comprises biasing means located between the base section and the grip portion to bias the base section towards a predetermined position relative to the grip portion.

9. A hammer as claimed in claim 7, wherein the handle is mounted on the body via a guide mechanism which enables the handle to pivot relative to the body, the guide mechanism comprising a first part mounted on the body and a second part mounted on the handle, one part comprising at least one peg which is rotatably mounted within an aperture formed in the other part.

10. A hammer as claimed in claim 1, wherein the hammer mechanism comprises a cylinder mounted within the body;

a piston slideably mounted within the cylinder;

a wobble bearing which converts the rotary output of the motor into an oscillating movement of the piston within the cylinder; and a ram slideably mounted in the cylinder and which is reciprocatingly driven by the oscillating piston and which imparts impacts to a cutting tool when held in the tool holder.

11. A hammer as claimed in claim 10, wherein there is further provided a beat piece mounted within the housing which transmits the impacts from the ram to a cutting tool when held in the tool holder.

12. A hammer as claimed in claim 1, wherein the hammer mechanism comprises a cylinder mounted within the body;

a piston slideably mounted within the cylinder;

a crank mechanism which converts the rotary output of the motor into an oscillating movement of the piston within the cylinder;

a ram slideably mounted in the cylinder and which is reciprocatingly driven by the oscillating piston and which imparts impact to a cutting tool when held in the tool holder.

13. A hammer as claimed in claim 1, wherein the position of the axis of pivot is fixed relative to the position of the body.

14. A hammer as claimed in claim 1, wherein the axis of pivot is located within a plane which extends perpendicularly to a drive axis.

15. A hammer as claimed in claim 1, wherein the axis of pivot does not intersect with a drive axis.

* * * * *